US005259130A

United States Patent [19]

Rohr

[11] Patent Number: 5,259,130

[45] Date of Patent: Nov. 9, 1993

[54] FLOATING GRAB INSTALLATION FOR THE RECOVERY OF SAND AND GRAVEL

[75] Inventor: Wolfgang Rohr, Speyer/Rh., Fed. Rep. of Germany

[73] Assignee: Rohr GmbH, Fed. Rep. of Germany

[21] Appl. No.: 900,316

[22] Filed: Jun. 18, 1992

[30] Foreign Application Priority Data

Jul. 20, 1991 [DE] Fed. Rep. of Germany ... 9108952[U]

[51] Int. Cl.[5] ..... E02F 3/413; E02F 7/02; E02F 7/06

[52] U.S. Cl. ..... 37/338; 37/341; 414/137.7; 414/141.1; 414/141.2; 414/142.3; 299/9

[58] Field of Search ..... 37/54, 69, 71; 414/137.7, 137.8, 137.6, 141.1, 141.2, 141.7, 142.3, 142.9, 142.4, 142.5; 299/9

[56] References Cited

U.S. PATENT DOCUMENTS

| | | | |
|---|---|---|---|
| 496,342 | 4/1893 | Collins | 37/71 X |
| 698,032 | 4/1902 | Long | 414/142.4 |
| 1,315,921 | 9/1919 | Fouchy | 414/142.4 X |
| 1,603,498 | 10/1926 | Wallace | 414/142.4 |
| 3,604,573 | 9/1971 | Leitch | 414/142.9 |
| 4,216,997 | 8/1980 | Fiebig | 414/142.9 X |
| 5,072,991 | 12/1991 | Rohr | 37/71 X |

FOREIGN PATENT DOCUMENTS

| | | | |
|---|---|---|---|
| 37496 | 11/1886 | Fed. Rep. of Germany | 414/138.7 |

*Primary Examiner*—Randolph A. Reese
*Assistant Examiner*—Arlen L. Olsen
*Attorney, Agent, or Firm*—Kinzer, Plyer, Dorn, McEachran & Jambor

[57] ABSTRACT

A floating grab installation for recovery of sand and gravel is disclosed. The installation includes a catamaran-type float or pontoon having a gripper and gripper support thereon. The gripper transfers the sand and gravel to an underwater tank having an endless bucket dredge which plunges to its lowest point.

16 Claims, 7 Drawing Sheets

FLOATING GRAB INSTALLATION FOR THE RECOVERY OF SAND AND GRAVEL

BACKGROUND OF THE INVENTION

Field of the Invention

The invention relates to a floating grab installation for the recovery of sand and gravel, with a bearing frame mounted on a pontoon or catamaran-type float for a trolley installation which presents a horizontally displaceable trolley with gripper.

The invention relates, further, to a floating grab installation for the recovery of sand and gravel with a jib installation mounted on a float (pontoon) or catamaran-type float, with extensible and retractable jib and gripper arranged thereon.

The invention relates further to a floating grab installation for the recovery of sand and gravel with a stationary hoisting mechanism arranged on a float or catamaran-type floating body, to which there is allocated a bunker car installation with a horizontally displaceable bunker car with tipping or scrapping grate, the grate being arranged underneath a gripper.

Background Art

Such floating dredges are known, which are used for the recovery of sand and gravel. For the dredging double-shell grippers are employed, the opening and closing occurring either with the aid of cables or by a hydraulic arrangement. The gripper is suspended on a trolley, which is constructed for either self-driving, or has a cable drive. For the raising and lowering of the gripper there is arranged on the trolley a hoisting mechanism which drives the cable winch.

In other floating dredges, for a gripper mounted on the jib there are arranged luffing jibs and a hoisting mechanism. Such floating dredges are used above all for relatively low outputs in a point dredging operation.

Further, floating dredges are known in which on a rigid winch mechanism there is arranged a simple gripper or also a double-gripper system. Underneath the gripper there is present a displaceable bunker car, into which there occurs an emptying of the gripper.

The disadvantage of these known floating grab installations lies in that the gripper has to be drawn very high above the water in order to pass over the funnel with the tipping or scraping grate. Here, most of the energy is consumed, whereby the conveyance performance is reduced.

A further substantial disadvantage lies in that the drainage occurs over a screen or a dosaging silo, which requires a special construction height. Thereby there is likewise yielded an increased energy requirement as well as a lower conveyance performance. In the case of fouled or muddied material an exact dosage onto the drainage machine is hardly possible.

Underlying the invention is the problem of developing floating grab installations of the known type in such a way that the grippers do not have to be hoisted out of the water, or the hoisting height of the gripper is considerably reduced, and therewith there is achieved a saving in energy and heightening of conveyance performance.

SUMMARY OF THE INVENTION

This problem is solved according to the invention by the means that to the float body there is attached an underwater tank, into which at the lowest point there plunges a bucket dredge guided obliquely upward.

In a floating grab installation for the recovery of sand and gravel with a stationary hoisting mechanism mounted on a pontoon, possibly catamaran-type floating body, to which there is allocated a bunker car installation with a horizontally displaceable bunker car with tipping or scraping grate, it is proposed according to the invention that underneath the grate there be connected an underwater tank, into which at the lowest point there plunges (enters) a bucket dredge guided obliquely upward.

Advantageously there is followed a procedure such that the underwater tank is constructed as an upcurrent tank with spray nozzles.

It is further proposed that between the gripper and the underwater tank there be arranged a tipping or scraping grate.

An advantageous form of execution provides that on the upper edge of the container at the water line there is arranged a surrounding overflow gutter, onto which there is connected an off-flow gutter.

One advantageous form of execution provides that the underwater tank is connected by means of a funnel to the tipping or scraping grate, the side walls of which are directed as a chute against the bottom of the tank.

It is advantageous that on the float body there is arranged a pumping sump.

Further, a procedure is followed such that on the outlet side of the bucket dredge there is engaged a dewatering machine.

Finally it is proposed that the fine material accumulating on the dewatering machine be guided over a chute to the underwater tank.

The invention incorporates the advantage that the gripper does not have to be lifted out of the water or the hoisting height of the gripper above water is substantially reduced. Associated with the working-up (elevating or lifting) installation there is yielded, as compared to a conventional installation, a high saving in energy, which lies on the order of 40%, as well as a conveyance performance improvement of at least 10%. Here there is bridged the structural height of the dewatering machine engaged on outlet side and of the dosaging silo with the bucket ladder. By the bucket ladder there is possible an exact dosage onto the dewatering screen or the conveyance bands. By variable speed there can occur an adaptation to the dredging material. A large supply silo can be dispensed with. The dredging material lies in an underwater tank and has a natural upward drive, which is to the benefit of the floating position of the installation. Further, the gravel dewatering and desludging, as compared to the known de-sliming machines, can be carried out more simply and, through the amount and the pressure of the upward-flowing water, can always be easily adapted to the dredging material. Altogether, therefore, there is yielded an improved efficiency with the floating grab installation as well s a de-sliming with the least expenditure.

BRIEF DESCRIPTION OF THE DRAWINGS

The invention is explained in detail in the following specification with the aid of examples of execution represented in the drawings.

DETAILED DESCRIPTION OF THE PREFERRED EMBODIMENTS

Figure 1:
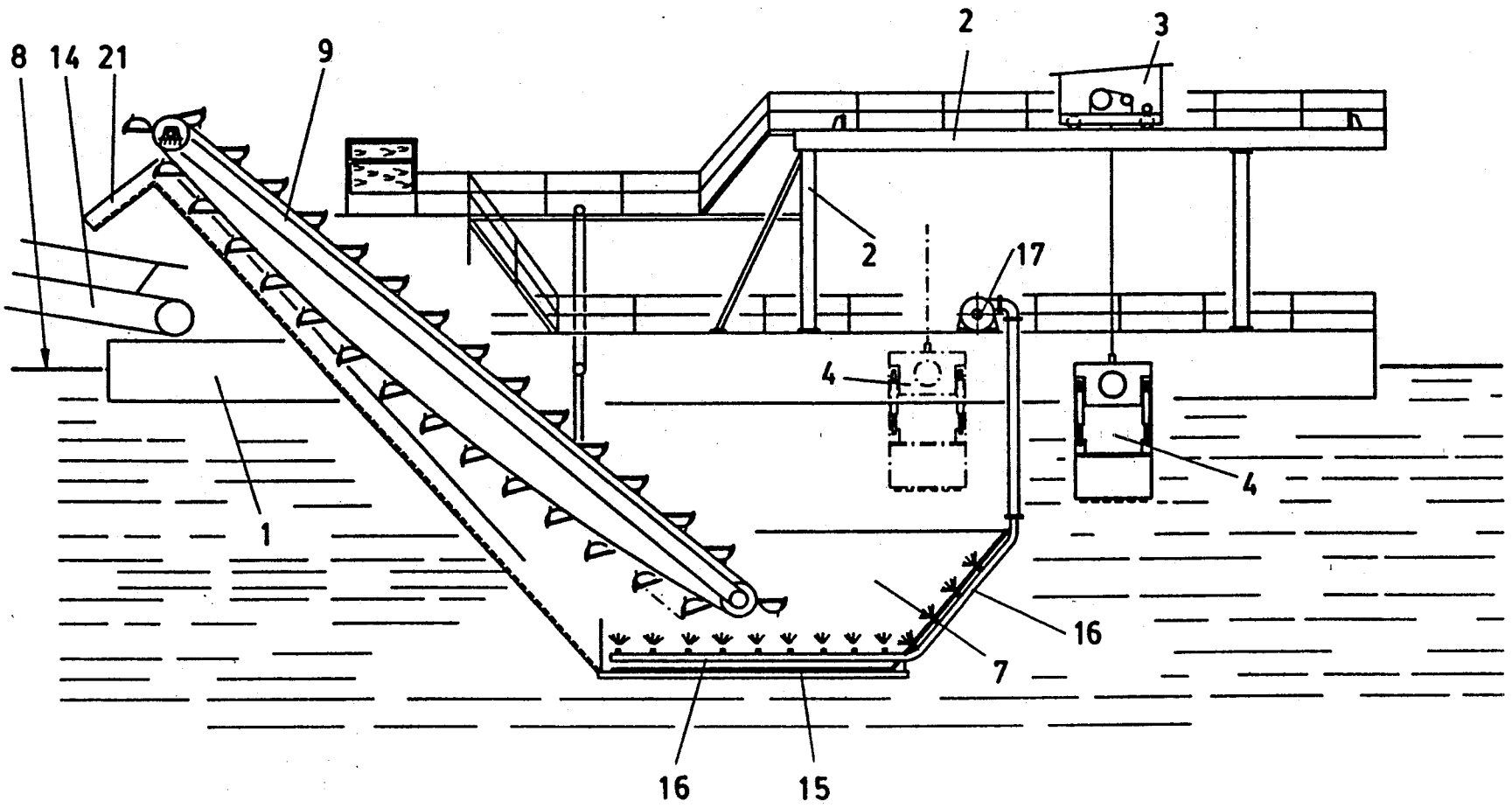
FIG. 1 shows an elevation view of a floating grab installation with trolley installation, FIG. 2 a plan view of the installation according to FIG. 1, FIG. 3 an elevation view of a floating grab installation with trolley installation and a grate, FIG. 4 a view along the line A—A in FIG. 3, FIG. 5 a view along the line B—B in FIG. 3, FIG. 6 a view along the line C—C in FIG. 3, FIG. 7 a floating grab installation in elevation with a trolley installation and a catamaran-type float, FIG. 8 a floating grab installation in elevation with a jib installation and FIG. 9 a floating grab installation in elevation with a bunker car installation and stationary hoisting mechanism.
Figure 2:
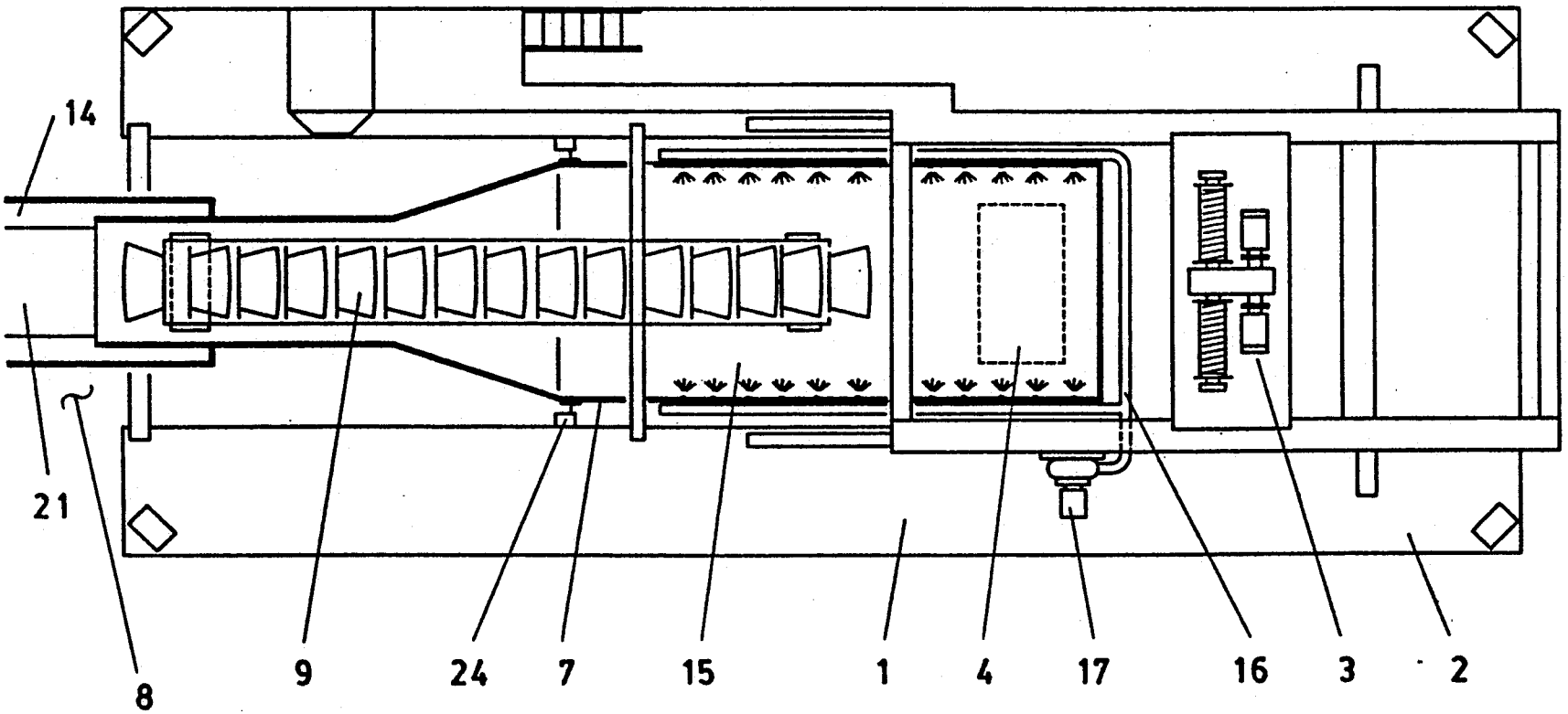
Figure 3:
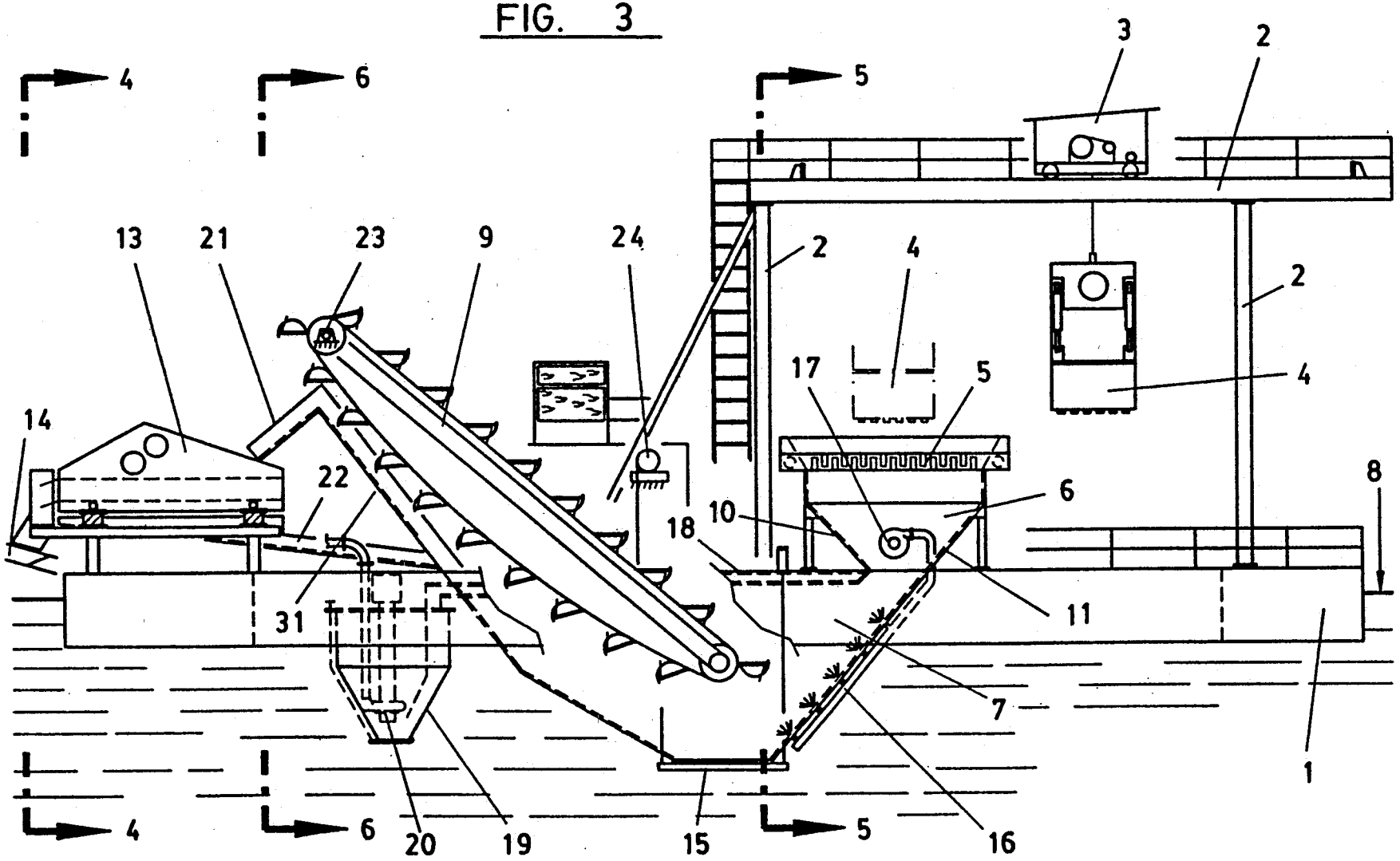

In the floating grab installation represented in FIGS. 1 and 2 there is present on a float 1 a bearing or support frame 2 with a horizontally displaceable trolley installation 3, on which there is mounted a gripper 4. To the float 1 there is attached an underwater or accumulator tank 7. This tank 7 is located underneath the water level 8, in which arrangement at the bottom 15 of this container a belt-type bucket dredge 9 or bucket ladder which is guided obliquely upward. The material delivered from the bucket dredge 9 passes over a chute 21 to a floating band 14.

This form of excavation is especially suited for well-dredgeable material in which no erratic blocks, tree trunks and the like are present. There is yielded here an optimal saving in energy, since the gripper is not lifted out of the water.

If the material is muddied and fouled, then the underwater tank 7 is constructed as an upcurrent container, in which the undesired fine sands along with fossil components are discharged through dosaged amounts of water and by pressure. For this there is present on the side wall running obliquely to the container bottom 15, as well as obliquely to the container bottom 15, a pipe 16 with upcurrent (upwardly directed spray) nozzles, which is connected to a pump 17.

In the form of excavation of the floating grab installation represented in FIGS. 3 to 6, on the float 1 there, is mounted a tipping or scraping grate 5, which is juxtaposed over a funnel 6 with the underwater tank 7. The side walls 10 or above all the side walls 11 of the funnel 6 act as a chute for the material fed over the grate. For the after-drainge there is arranged on the outlet side of the bucket dredge a drainage screen 13, FIG. 4, from where the material passes onto the floating band 14.

Insofar as the underwater tank is used as upcurrent container there serves an overflow gutter 18 mounted above on the water line on the container 7 for the collecting of these components flushed upward, which pass into a sump pump tank 19 with underwater pump 20, from where they are conveyed ashore or to dredged-out places in the sea.

The material brought out from the bucket dredge 9 passes over a chute 21 to the dewatering screen 13, the downward flow of the dewatering machine 13 being positioned over a reflux gutter 22 with the underwater tank 7, so that therewith, as a rule, well-usable sand returns into the circulation. The fine material being discharged on the empty side of the belt of the bucket dredge 9 is returned over the oblique wall 31 acting as a chute to the container 7 and is subject thus to the further processing operation.

Figure 5:
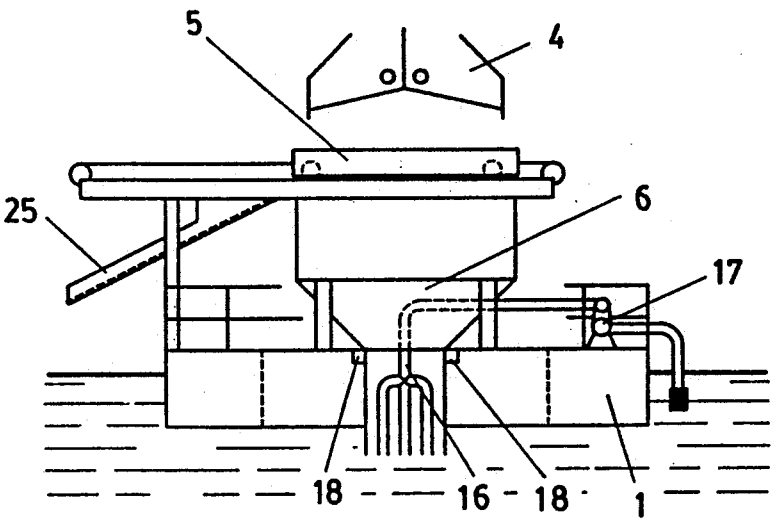
Figure 4:
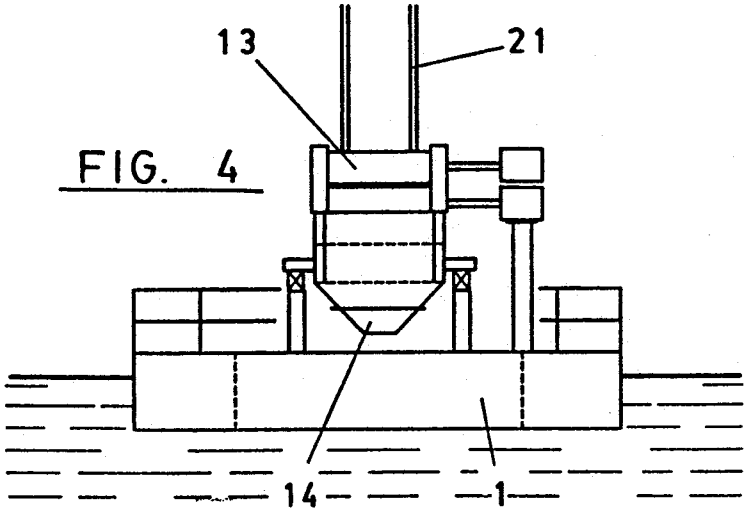
Figure 6:
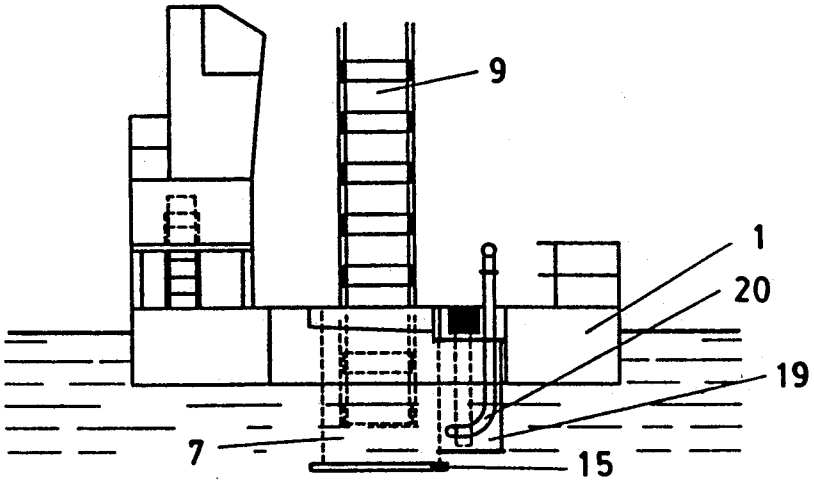

The bucket ladder or belt-type dredge 9 is swingably arranged on the upper roll 23 on a stationary bearing, while the lower end is arranged on (connected to) a hoisting winch 24, so that the slope can therewith be adjusted. Further, the grate 5 is equipped with a chute 25 for oversized grain (FIG. 5).

Figure 7:
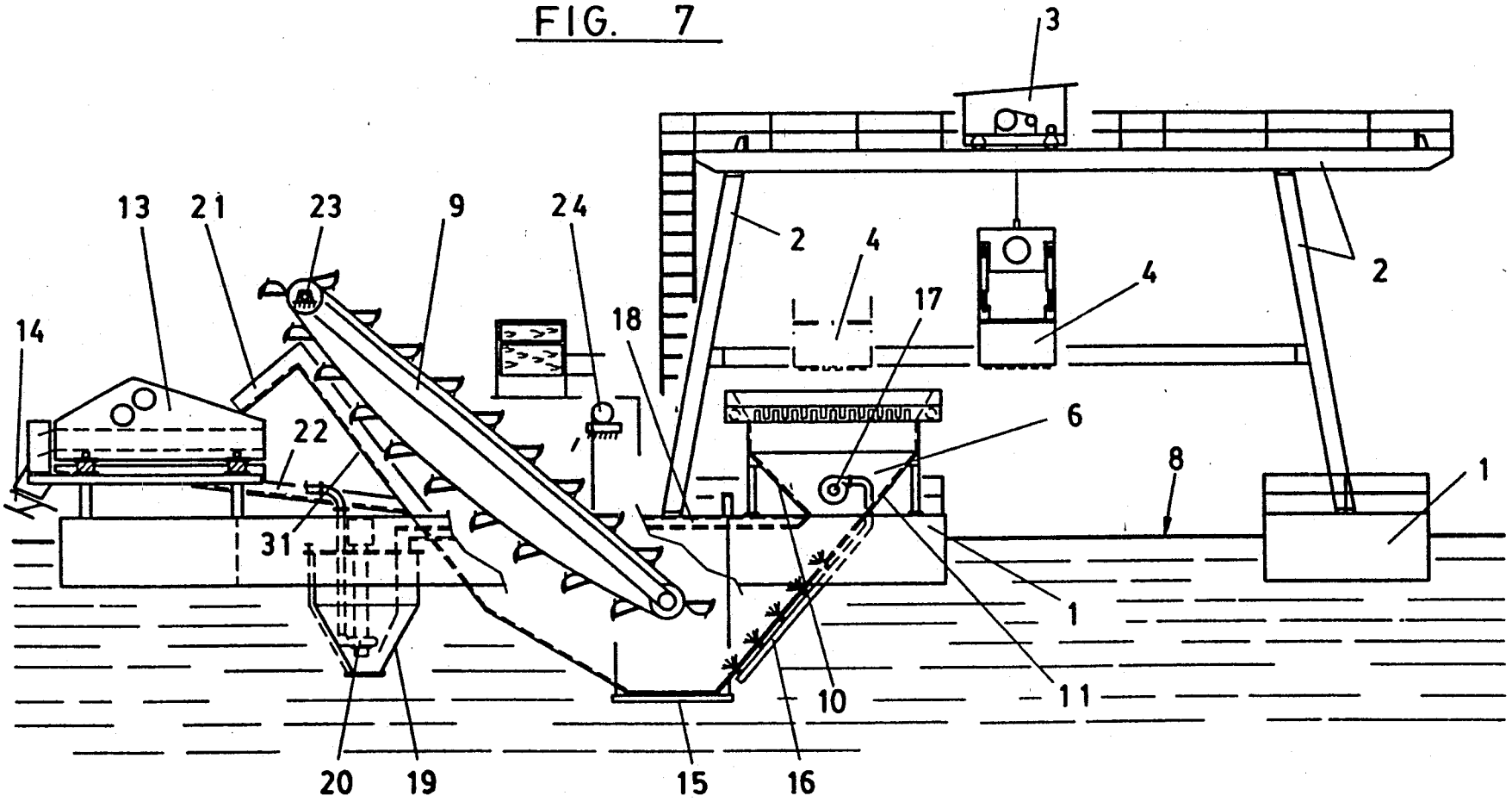

In the form of excavation represented in FIG. 7 the float 1 is constructed as a catamaran-type float or pontoon, in which the floating grab installation otherwise has the same features as those of the installation represented in FIGS. 1 and 2 and FIGS. 3 to 6, respectively.

Figure 8:
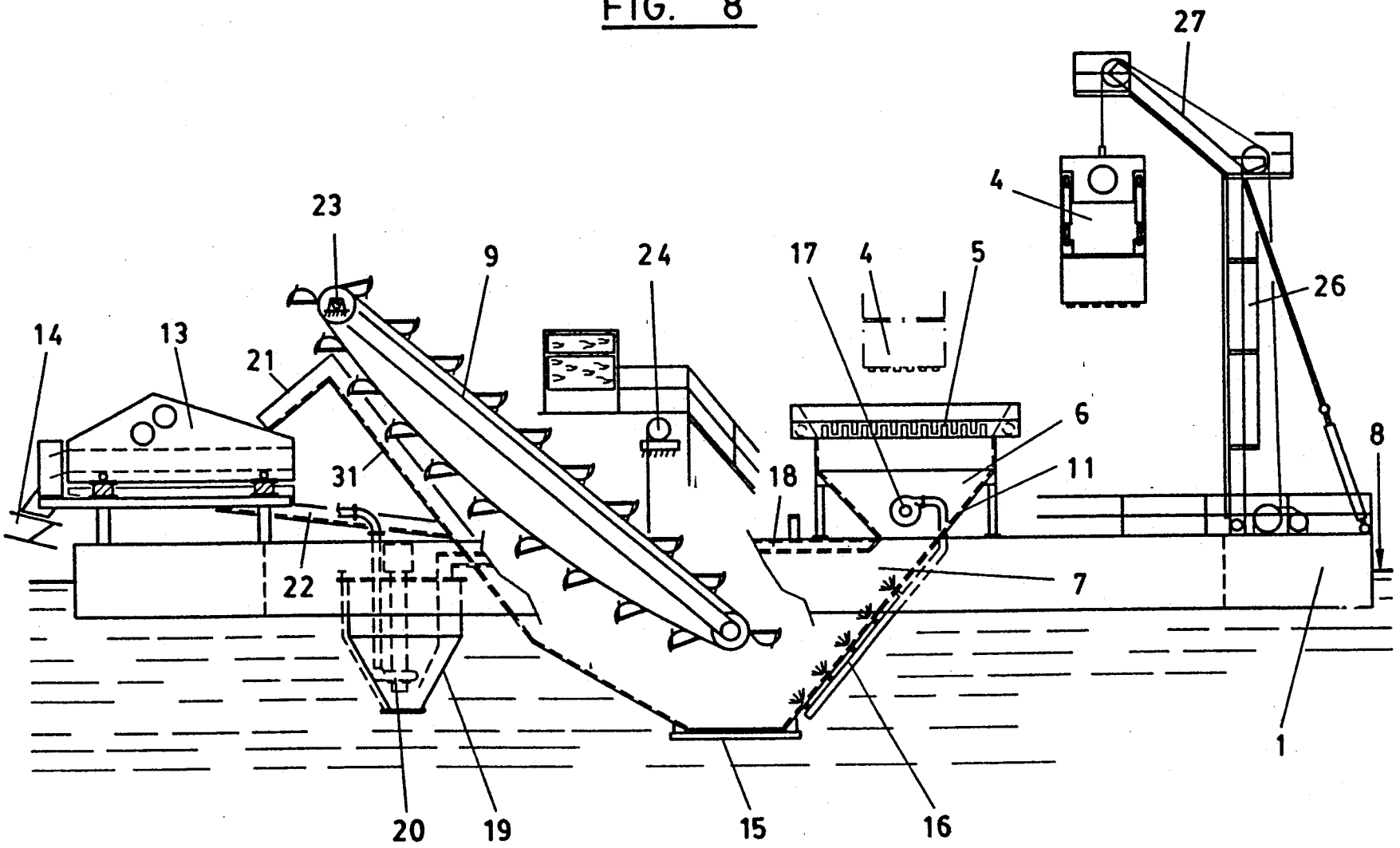

According to the floating grab installation shown in FIG. 8, instead of a trolley installation there is provided a jib crane installation 26, in which the gripper 4 is mounted on an extensible and retractable jib 27.

Figure 9:
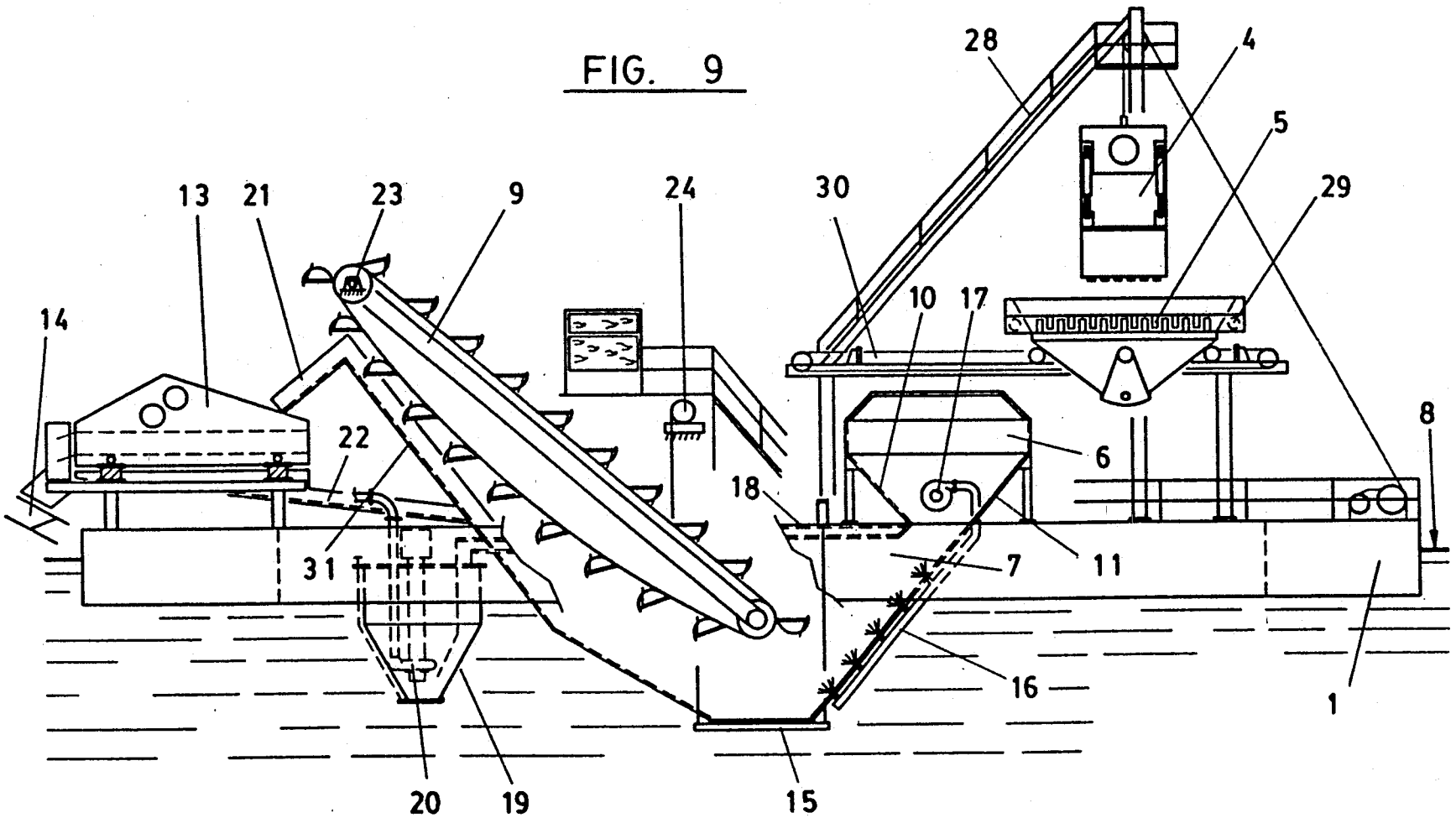

Finally, FIG. 9 shows a floating grab installation in which the gripper 4 or possibly also a double gripper is arranged on a rigid hoisting mechanism 28. The tipping or scraping grate 5 is arranged on a bunker car 29, which is displaceable on a track 30 and can be pushed to the funnel 6 into the used position.

What is claimed is:

1. Floating grab installation for the recovery of sand and gravel including a float body having means supporting a gripper, characterized in that to the float body (1) there is attached an underwater tank (7) having an internal predetermined water line, and into which at a lowest point of said tank there plunges an obliquely upward-conducted bucket dredge (9).

2. Floating grab installation according to claim 1, characterized in that the underwater tank (7) is constructed as an upcurrent container which is provided with spray nozzles (16).

3. Floating grab installation according to claim 1, characterized in that between the gripper (4) and the underwater tank (7) there is arranged a tipping or scraping grate (5).

4. Floating grab installation according to claim 3, characterized in that the underwater tank (7) is connected by means of a funnel (6) to the tipping or scraping grate (50, the side walls (10, 11) of which are directed as a chute against the tank bottom.

5. Floating grab installation according to claim 1, characterized in that on an upper edge of the tank (7) there is arranged at the water line a surrounding overflow gutter (18), to which an outlet gutter (18') is connected.

6. Floating grab installation according to claim 1, characterized in that on the float body (1) there is arranged a sump pump (19).

7. Floating grab installation according to claim 1, said bucket dredge further comprising an outlet side and characterized in that on the outlet side of the bucket dredge (9) there is engaged a dewatering machine 913).

8. Floating grab installation according to claim 7 characterized in that fine material accumulating on the dewatering machine (13) is conducted over a chute (22) to the underwater tank (7).

9. Floating grab installation for the recovery of sand and according to claim 1 wherein said gripper is mounted on an extensible and retractable hoist.

10. Floating grab installation according to claim 9, characterized in that the underwater tank (7) is provided with upcurrent spray nozzles (16).

11. Floating grab installation according to claim 9, characterized in that between the gripper (4) and the underwater tank (7) there is arranged a grate (5).

12. Floating grab installation according to claim 9, characterized in that along an upper edge of the tank (7) there is arranged at the water line a surrounding overflow gutter (18), to which an outlet gutter (18') is connected.

13. Floating grab installation according to claim 9, characterized in that the underwater tank (7) is connected by a funnel (6) to a grate (5) having side walls, the side walls (10, 11) being directed as a chute against a bottom (15) of the tank.

14. Floating grab installation according to claim 9, characterized in that on the float body (1) there is arranged a sump pump (19).

15. Floating grab installation according to claim 9, characterized in that on an outlet side of the bucket dredge (9) there is engaged a dewatering machine (13).

16. Floating grab installation according to claim 9, characterized in that fine material accumulating on a dewatering machine (13) is conducted over a chute (22) to the underwater tank (7).

* * * * *